US010814335B2

(12) United States Patent
Clavaguera et al.

(10) Patent No.: US 10,814,335 B2
(45) **Date of Patent: *Oct. 27, 2020**

(54) SELECTIVE AEROSOL PARTICLE COLLECTING METHOD AND DEVICE, ACCORDING TO PARTICLE SIZE

(71) Applicant: COMMISSARIAT A L'ENERGIE ATOMIQUE ET AUX ENERGIES ALTERNATIVES, Paris (FR)

(72) Inventors: Simon Clavaguera, Grenoble (FR); Arnaud Guiot, Saint-Egreve (FR); Michel Pourprix, Montlhery (FR); Nicolas Daniel, Saint-Martin d'Heres (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 346 days.

This patent is subject to a terminal disclaimer.

(21) Appl. No.: 15/744,332

(22) PCT Filed: Jul. 28, 2016

(86) PCT No.: PCT/EP2016/067992
§ 371 (c)(1),
(2) Date: Jan. 12, 2018

(87) PCT Pub. No.: WO2017/017179
PCT Pub. Date: Feb. 2, 2017

(65) Prior Publication Data

US 2018/0200727 A1 Jul. 19, 2018

(30) Foreign Application Priority Data

Jul. 28, 2015 (FR) ..... 15 57221

(51) Int. Cl.
*B03C 3/02* (2006.01)
*B03C 3/06* (2006.01)
(Continued)

(52) U.S. Cl.
CPC ..... *B03C 3/025* (2013.01); *B03C 3/06* (2013.01); *B03C 3/12* (2013.01); *B03C 3/368* (2013.01);
(Continued)

(58) Field of Classification Search
CPC combination set(s) only.
See application file for complete search history.

(56) References Cited

U.S. PATENT DOCUMENTS 3,413,545 A * 11/1968 Whitby ..... G01N 15/0266 324/71.1
3,747,299 A 7/1973 Chiang
(Continued)

FOREIGN PATENT DOCUMENTS

DE 3324803 A1 1/1985
DE 196 50 585 A1 6/1998
(Continued)

OTHER PUBLICATIONS

W. Hinds, "Aerosol Technology", John C. Wiley and Sons, 2nd Edition, 1999, pp. 223, 330, 341.
(Continued)

*Primary Examiner* — Christopher P Jones
*Assistant Examiner* — Sonji Turner
(74) *Attorney, Agent, or Firm* — Pearne & Gordon LLP

(57) ABSTRACT

The invention relates to a method and device for collecting particles which may be present in an aerosol. The invention consists in electrostatically collecting all the particles in an aerosol, but uncoupling mechanisms of particle charging by unipolar ion diffusion, for charging then collecting the finest
(Continued)

particles, from particle charging by a corona effect electrical field, for charging then collecting the biggest particles in a different collection zone from the collection zone for the finest particles. The invention also relates to the use of such a device as ionisation chamber or for evaluating the exposure of workers or consumers to nanoparticles.

12 Claims, 7 Drawing Sheets

(51) Int. Cl.

| | |
|---|---|
| ***B03C 3/12*** | (2006.01) |
| ***B03C 3/36*** | (2006.01) |
| ***B03C 3/41*** | (2006.01) |
| ***B03C 3/49*** | (2006.01) |
| *B03C 3/38* | (2006.01) |
| *B03C 3/47* | (2006.01) |

(52) U.S. Cl.
CPC ..... *B03C 3/41* (2013.01); *B03C 3/49* (2013.01); *B03C 3/38* (2013.01); *B03C 3/47* (2013.01)

(56) References Cited

U.S. PATENT DOCUMENTS

| | | | | |
|---|---|---|---|---|
| 6,004,376 | A | 12/1999 | Frank | |
| 6,761,752 | B2 * | 7/2004 | Fissan | B03C 3/06 95/74 |
| 8,044,350 | B2 | 10/2011 | Chen et al. | |
| 2010/0101420 | A1 | 4/2010 | Kakinohara et al. | |
| 2013/0036906 | A1 | 2/2013 | Dunn | |
| 2015/0226427 | A1 * | 8/2015 | Laitinen | B03C 3/743 95/79 |
| 2018/0200728 | A1 * | 7/2018 | Pourprix | B03C 3/12 |

FOREIGN PATENT DOCUMENTS

| | | |
|---|---|---|
| EP | 2 131 017 A1 | 12/2009 |
| JP | 58-166946 A | 10/1983 |

OTHER PUBLICATIONS

P. Intra and N. Tippayawong, "Aerosol an Air Quality Research", Taiwan Association for Aerosol Research, 2011, pp. 187-209.
G.W. Hewitt, "The Charging of small Particles for Electrostatic Precipitation", AIEE Trans., 76: pp. 300-306, Jul. 1957.
G. Biskos, K. Reavell, N. Collings, "Electrostatic Characterisation of Corona-Wire Aerosol Chargers", J. Electrostat. 63: 69-82, 2005.
D.Y.H. Pui, S. Fruin, P.H. McMurry, "Unipolar Diffusion Charging of Ultrafine Aerosols", Aerosol Sciences Technology 8: 173-187, 1988.
P.Bérard, "Etude du vent ionique produit par décharge couronne àpression atmosphésique pour le contrôle d'écoulement aérodyuamique" [Study of the ionic wind produced by corona discharge at atmospheric pressure for controlling aerodynamic flow], Engineering Sciences, Ecole Centrale Paris, 2008, NNT: 2008ECAP1085, tel-0107138 and English Summary.
French Preliminary Search Report from Corresponding French Application No. FR1557221 dated Jun. 10, 2016.
International Search Report for corresponding International Application No. PCT/EP2016/067992 dated Oct. 6, 2016.
Written Opinion for corresponding International Application No. PCT/EP2016/067992 dated Oct. 6, 2016.

* cited by examiner

SELECTIVE AEROSOL PARTICLE COLLECTING METHOD AND DEVICE, ACCORDING TO PARTICLE SIZE

TECHNICAL FIELD

The present invention relates to the field of collecting and analyzing particles likely to be present in suspension in an aerosol.

More specifically, it relates to the production of an electrostatic device for collecting particles by electrostatic precipitation, including nanoparticles contained in aerosols.

The aim of the present invention is to allow collection of particles in suspension in aerosols that is simultaneous but selective as a function of their dimensions, with the selectivity preferably intended to collect, and at the same time separate, micron-sized or sub-micron-sized particles, i.e. bigger than or equal to 300 nm, and nanometric particles.

"Nanoparticle" is understood in terms of the standard definition according to standard ISO TS/27687: a nano-object, the three dimensions of which are on the nanometric scale, i.e. a particle with a nominal diameter that is less than approximately 100 nm.

PRIOR ART

Since the 1970s, awareness of the environmental and health implications caused by aerosols has been the source of new technological developments in order to better evaluate the associated risks.

The field rapidly expanded in the 1980s to include the use of aerosols in high-technology production methods and the control of aerosol contamination in ultra-clean atmospheres.

From the 1990s, research intensified on the properties of ultrafine particles, i.e. those smaller than 100 nm, and on the effect of aerosols on the climate. The field is therefore very broad, since it simultaneously covers the fields of industrial hygiene, of air pollution control, of inhalation toxicology, of atmospheric physics and chemistry and of radioactive aerosol contamination in installations or in the environment.

More recently, the rapid growth of nanotechnologies in various fields, such as health, microelectronics, energy technologies or everyday consumer products such as paints and cosmetics, means that it is crucial for work to continue on the health and environmental implications of these new materials in order to ensure optimal safety conditions.

Therefore, methods and tools need to be developed for evaluating the exposure of workers, consumers and the environment to particles, and particularly to nanoparticles.

The development of methods and devices for sampling and analysing aerosols over a wide range of particle sizes, up to nanometric size, is thus a critical issue in terms of public health and of the prevention of the associated risks.

In particular, the development of sampling devices adapted to be portable and to be fixed as a unit to coveralls of a worker at a station for manufacturing nano-objects or processing or using nanomaterials could prove to be essential.

Numerous devices exist for sampling and collecting particles in suspension in aerosols with a view to analyzing them in situ or in a laboratory. They may implement collection by filtration on fibers or on porous membranes, collection by diffusion for the finest particles, collection under the effect of an inertial force field (impactors, cyclones, centrifuges) or gravity force field (sedimentation chambers, elutriators) for the biggest particles, or even collection under the effect of an electric, thermal or radiation force field.

Among these devices, those which are electrostatic, i.e. the operating principle of which is based on implementing an electric field, particularly an intense electric field for creating a corona discharge effect, are commonly used.

When an intense electric field is generated in a volume where aerosol particles are present, said particles may be electrically charged through two distinct charging mechanisms and this may occur concurrently.

Publication [1], particularly figure. 15.4 on page 330 of this publication, shows that the unipolar ion diffusion charging mechanism, associated with the field charging mechanism, is applicable to a wide range of particle sizes, at least for particles with dimensions between 0.01 and 10 μm. It is also clear that the unipolar ion diffusion charging mechanism is especially predominant for the finest particles, typically the nanoparticles, i.e. those smaller than 100 nm. By contrast, the field charging mechanism is more efficient for the big particles, i.e. the micron-sized and sub-micron-sized particles (>300 nm).

By way of an example, if the electrical mobility of a particle, denoted Z, is considered to be approximately 1 $cm^2/st \cdot V \cdot s$ in CGS electrostatic units, that is $3.3 \times 10^{-7}$ $m^2/V \cdot s$ in SI units, then this particle placed between two plane and parallel plates that generate an electric field E of $10^5$ V/m reaches a speed W equal to the product Z*E, that is W of approximately 0.033 m/s. It clearly may be seen that the electrostatic force generates speeds much higher than the other force fields experienced by a particle, namely the gravity, inertial, thermal and radiation fields. This advantage is exploited in the operation of commercially available electrostatic purifiers, where the diffusion charging and field charging processes may act together.

Electrically charging aerosol particles requires the presence of a high concentration of unipolar ions. The method that is by far the most efficient for creating these ions in atmospheric air is the corona discharge method.

In order to produce a corona discharge, an electrostatic field must be established with a geometry that allows it to be rendered non-uniform. More specifically, this high electric field (several thousand to tens of thousands of volts per centimeter in the vicinity of the discharge electrode) is induced by two electrodes disposed close to each other: a first biased electrode, or discharge electrode, generally in the form of a wire or a point, being disposed facing a second electrode, which electrode is in the form of a counter electrode, generally having a plane or cylindrical geometry. The electric field that exists between the two electrodes ionizes the gas volume located in the inter-electrode space and particularly a sheath or ring of ionized gas located around the discharge electrode. The created charges, by migrating toward the counter electrode, charge the particles to be separated that are contained in the gas. The charged particles that are thus created then migrate toward the counter electrode, on which they may be collected. This counter electrode is commonly called collection electrode. Due to the required electric field level, a discharge electrode needs to be used that has a (very) low curvature radius. The discharge electrodes that are encountered are therefore generally either fine points or small diameter wires. Therefore, through a process based on the electrons and the ions created by natural irradiation, the electrons are accelerated in the intense electric field created in the vicinity of the electrode with a (very) low curvature radius. Due to the high imposed voltage, if this field exceeds a critical value, an avalanche effect causes the ionization of the air in this space. This phenomenon is called corona discharge.

By way of an example, FIGS. 1A to 1E show some configurations of electrodes that are best adapted for obtaining a corona discharge, namely, respectively, a point-plane (FIG. 1A), blade-plane (FIG. 1B), wire-plane (FIG. 1C), wire-wire (FIG. 1D), wire-cylinder (FIG. 1E) arrangement.

For example, in the point-plane configuration, if the point is positive relative to the plane, the electrons rapidly move toward the point, whereas the positive ions move toward the plane, then creating a positive unipolar space. Furthermore, an ion wind, also called ionic wind, is established, which is characterized by an airflow directed from the point toward the plane arising from the collisions of positive ions with the surrounding neutral molecules.

Conversely, if the point is negative relative to the plane, the positive ions move toward the point and the electrons move toward the plane by attaching to the air molecules in order to form negative ions. In any case, even if the process for creating positive or negative ions is not exactly symmetrical, the unipolar ions migrate from the point toward the plane with a high concentration of approximately $10^6$ to $10^9/cm^3$ and, regardless of the polarity, an electric wind arises that is directed from the point toward the plane. Thus, introducing aerosol particles into the point-plane space allows them to be charged with the same polarity as the point, using a field charging process. Furthermore, the field used to create the corona effect and the electric wind also participate in the field charging process.

For the other configurations shown in FIGS. 1B to 1E, the processes for producing ions and for field charging of the particles are similar in all respects.

Certain marketed electrostatic precipitators that are used to sample and collect particles on a support that enables analysis operate on this principle.

For example, figure. 15.9 on page 341 of publication [1], already cited, shows an arrangement that allows aerosol particles to be deposited on an electron microscope grid, the particles being charged and precipitated in a point-plane configuration.

Another example is shown in figure. 10.10 on page 223 of this same publication [1] and implements the charging and precipitation technique in a point-plane geometry for collecting aerosol particles on a piezoelectric crystal.

As already mentioned, the unipolar ion diffusion charging mechanism is predominantly applicable to the finest particles. This mechanism is increasingly implemented in nanoparticle metrology, particularly for determining their particle size. Indeed, many authors have studied and continue to study devices capable of providing the finest particles with high electrical mobility, in order to be able to select them in instruments adapted to this new field. In particular, article [2] may be cited to this end, which reviews most of the technologies developed to date, or even the principle developed by the author of publication [3], which uses a wire-cylinder configuration, which has been widely studied more recently, as shown in publication [4], but also previously (publication 5 [5]).

FIG. 2 is a schematic representation of a unipolar ion diffusion charging device, also called charger, the geometry of which is of the wire-cylinder type, as shown in publication [4]. The charger 10 comprises a body 1 with rotational symmetry in two parts that support a hollow metal cylinder 11 forming an external electrode connected to an alternating current power supply and a central metal wire 12 arranged along the axis of the body and connected to a high-voltage power supply, not shown. A cylindrical gate 14 forming an internal electrode is also annularly arranged around the central wire 12. The aerosol containing the particles to be charged circulates in the charger 10, from the inlet orifice 17 to the outlet orifice 18, by passing through the space 15 that is delimited between the internal electrode 14 formed by the gate and the external electrode 11 formed by the cylinder.

This charger 10 operates as follows: ions are produced by a corona effect on the central wire 12 and are collected by the gated internal electrode 14 taken to a low potential, typically to ground. A portion of these ions exits this gate 14 to proceed toward the internal surface of the peripheral cylinder 11 due to the voltage applied thereto. The aerosol particles pass through the space 15 between the gate 14 and the cylinder 11 and are thus charged by diffusion by the unipolar ions that exited the gate 14. The diffusion charging mechanism operates as a function of the product N*t, where N represents the concentration of unipolar ions and t represents the residence time of the particles. The diffusion charging mechanism is the only mechanism able to take place as it is not possible to have a field charging mechanism since the electric field is very weak in the space 15.

It is worthwhile noting that the process for charging aerosols by unipolar ion diffusion allows a given number of electric charges to be imparted to a particle of given size.

This principle is also implemented in differential electrical mobility analyzers (DMA), which are instruments capable of providing the particle size distribution of fine particles by counting the concentration of particles in a given electrical mobility classification. Such a device is implemented in U.S. Pat. No. 8,044,350 B2, for example.

It is clear from studying the prior art that a device has not been proposed that allows both the simultaneous collection of the particles contained in an aerosol, and which differ in size over a wide size range, typically between several nanometers and several tens of micrometers, and the separation thereof into limited size ranges, preferably separating the nanoparticles from the micron-sized particles.

Presently, a requirement exists for such a device, particularly in order to allow the subsequent analysis of the collected and separated particles in order to determine their concentration and their chemical composition sequentially as a function of their limited size range.

The general aim of the invention is thus to at least partially meet this need.

DISCLOSURE OF THE INVENTION

To this end, the initial subject of the invention is a method for collecting particles likely to be present in an aerosol, comprising the following steps:

- sucking the aerosol through a conduit from its inlet orifice to its outlet orifice;
- charging the finest particles, downstream of the inlet orifice, by unipolar ion diffusion in a space between an electrode in the form of a gate surrounding an electrode in the form of a wire generating a corona effect, and a first conductive portion of the internal wall of the conduit;
- generating an electric field without a corona effect in the space between an electrode and a second conductive portion of the internal wall of the conduit, in order to collect the finest particles charged by the diffusion charger by deposition onto a first collection zone (Zn);
- generating an electric field with a corona effect in the space between the wire or the point of an electrode and a third conductive portion of the internal wall of the conduit, in order to collect the biggest particles not charged by the diffusion charger by deposition onto a second collection zone (Zm) distinct from the first collection zone.

According to an advantageous embodiment, when the particles are radioactive, the method further comprises the following steps:

a/ collecting radioactive particles on the first and/or the second collection zone during a time period t1;

b/ counting pulses generated by the ionization current of the air in the spaces during a time period t2.

According to this embodiment, a step may be provided of emitting an alarm in the event that a predetermined threshold value of pulses counted in step b/is exceeded.

A further subject of the invention is a device for collecting particles likely to be present in an aerosol, comprising:

a conduit comprising an inlet orifice and an outlet orifice, between which the aerosol may circulate;

suction means for circulating the aerosol from the inlet orifice to the outlet orifice;

a unipolar ion diffusion charger, downstream of the inlet orifice, comprising an electrode in the form of a wire surrounded by an electrode in the form of a gate, the charger being adapted to charge the finest particles in the space separating the gate from a first conductive portion of the internal wall of the conduit by diffusing unipolar ions through the gate;

an electrode, downstream of the diffusion charger, adapted to generate an electric field without a corona effect in the space separating the electrode from a second conductive portion of the internal wall of the conduit and to thus collect the finest particles, previously charged by the diffusion charger, by deposition onto a first collection zone (Zn);

an electric field charger, downstream of the ion diffusion charger and of the nanoparticle collection zone, comprising an electrode in the form of a wire or a point adapted to generate an electric field with a corona effect in the space separating the wire or the point from a third conductive portion of the internal wall of the conduit and to thus charge, then collect, the biggest particles by deposition onto a second collection zone (Zm) distinct from the first collection zone.

Thus, the invention consists in electrostatically collecting all the particles present in an aerosol, but with decoupling of the mechanisms, on the one hand, for charging particles by unipolar ion diffusion in order to charge, then collect the finest particles and, on the other hand, for electric field charging with a corona effect in order to charge and collect the biggest particles in a different zone from the collection zone for the finest particles.

In other words, the invention consists in firstly electrically charging the fine particles by unipolar ion diffusion, then electric field charging the biggest particles and collecting each group of particles thus charged on a suitable support according to their size.

Therefore, the invention allows the particles to be carefully classified according to their particle size by depositing them in physically distinct zones.

In an advantageous embodiment, particle deposition may be carried out in concentric rings at different locations on the same flat substrate arranged orthogonal to the aerosol circulation direction.

According to this embodiment, the ionic wind advantageously may be exploited to induce a circulation of air through the device, which may allow the presence of a suction pump in the device to be dispensed with, the subsequent advantage of which is a lower weight for the device and a reduction of the disturbances inherent in a pump (vibrations, noise, etc.).

The substrate(s) on which the particle deposition collection zones are defined by deposition of particles then may be analyzed using conventional physical or physico-chemical characterization techniques, such as optical or electron microscopy, surface scanner, α, β, γ spectrometry if the particles are radioactive, X-ray fluorescence (XRF) spectroscopy, micro X-ray fluorescence (μ-XRF), laser-induced breakdown spectroscopy (LIB S), etc.

A collection device according to the invention is particularly well adapted for sampling particles in gaseous environments, particularly the air in premises or in the environment, in order to determine the concentration, the particle size, the composition of the aerosol particles that are likely to be inhaled.

According to a first embodiment:

the conduit is a hollow cylinder of revolution about a longitudinal axis (X);

the suction means are formed by a pump;

the first, second and third conductive portions of the wall are cylinder portions forming part of the conduit;

the field charger comprises an electrode in the form of a wire in a wire-cylinder configuration with the corresponding cylinder portion;

the ion diffusion charger wire, the electrode for generating an electric field without a corona effect and the wire of the field charger are distinct parts and are successively arranged one behind the other along the axis (X).

According to a second embodiment:

the conduit comprises a hollow element of revolution about a longitudinal axis (X) and a flat substrate arranged at one end of the hollow element orthogonal to the axis (X), the distance separating the hollow element from the flat substrate and its possible support defining the dimensions of the outlet orifice, the flat substrate forming a collection substrate defining both the first (Zn) and the second (Zm) collection zone;

the suction means are formed by the outlet orifice;

the first conductive portion of the wall is a portion of revolution forming the conduit;

the second and third conductive portions are grouped on the same collection substrate;

the field charger comprises an electrode in the form of a point in a point-plane configuration with the collection substrate, the point being adapted to generate a corona effect participating in the field charging of the particles but also for creating an electric field promoting the collection of species previously charged by the ion diffusion charger;

the wire of the ion diffusion charger, the electrode and the point of the field charger are portions of the same part exhibiting electrical continuity that extends along the axis (X).

The device according to this second embodiment may comprise plasma actuators arranged in the vicinity of the outlet.

Advantageously, the wire of the ion diffusion charger, the electrode for generating an electric field without a corona effect and the wire or the point of the field charger are connected to a high-voltage power supply, preferably between 2 and 6 kV.

The gate is preferably connected to a low-voltage power supply, preferably of approximately 100 V.

The first, second and third conductive portions are preferably connected at zero potential. Provision also may be made to supply the first conductive portion with low-voltage, typically approximately 50 V.

The collection device according to the invention may form, following a previous collection, an ionization chamber and a radioactive particle detector with an alarm function in the event that a predetermined threshold is exceeded.

A final subject of the invention is the use of a device as previously described for collecting particles while separating nanoparticles into the first collection zone (Zn) and micron-sized particles into the second collection zone (Zm).

The device also may be used as an ionization chamber.

An advantageous use of the device according to the invention is for evaluating the individual exposure of workers or of consumers to the nanoparticles.

DETAILED DESCRIPTION

Further advantages and features will become more clearly apparent upon reading the detailed description, which is provided by way of a non-limiting illustration, with reference to the following figures, in which.

Figure 4:
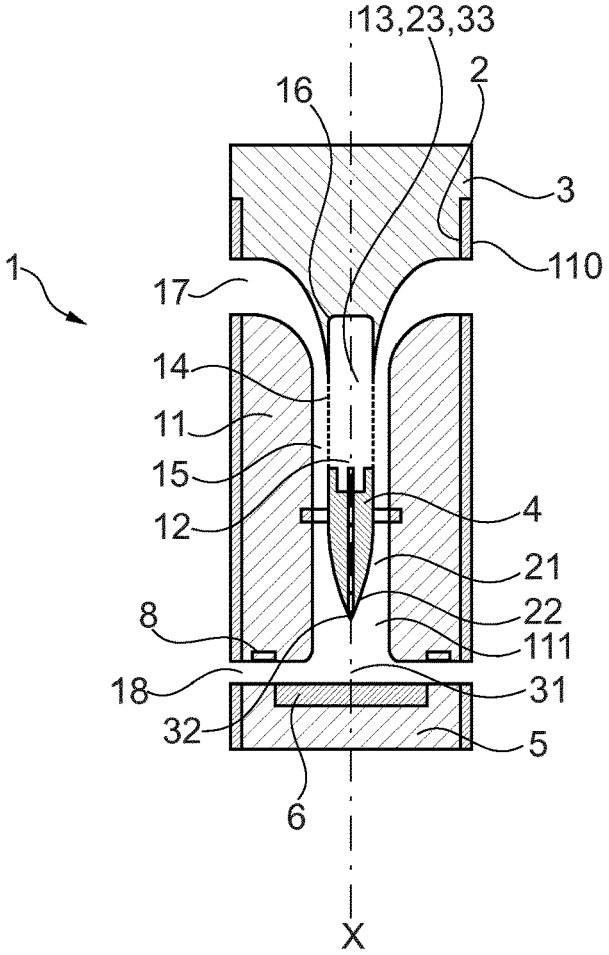
FIG. 4 is a schematic longitudinal cross-sectional view of a second example of a particle collection device according to the invention.

Throughout the present application, the terms "vertical", "lower", "upper", "low", "high", "below", "above", "height" are to be understood with reference to a collection device arranged vertically with the inlet orifice at the top, as shown in FIG. 4.

Similarly, the terms "inlet", "outlet", "upstream" and "downstream" are to be understood with reference to the direction of the suction flow through a collection device according to the invention. Therefore, the inlet orifice denotes the orifice of the device through which the aerosol containing the particles is sucked, whereas the outlet orifice denotes the orifice through which the air flow exits.

FIGS. 1A to 1E and 2 have already been described in the preamble. They are not described hereafter.

For the sake of clarity, the same elements of the collection devices according to the two illustrated examples are denoted using the same reference numerals.

Figure 3:
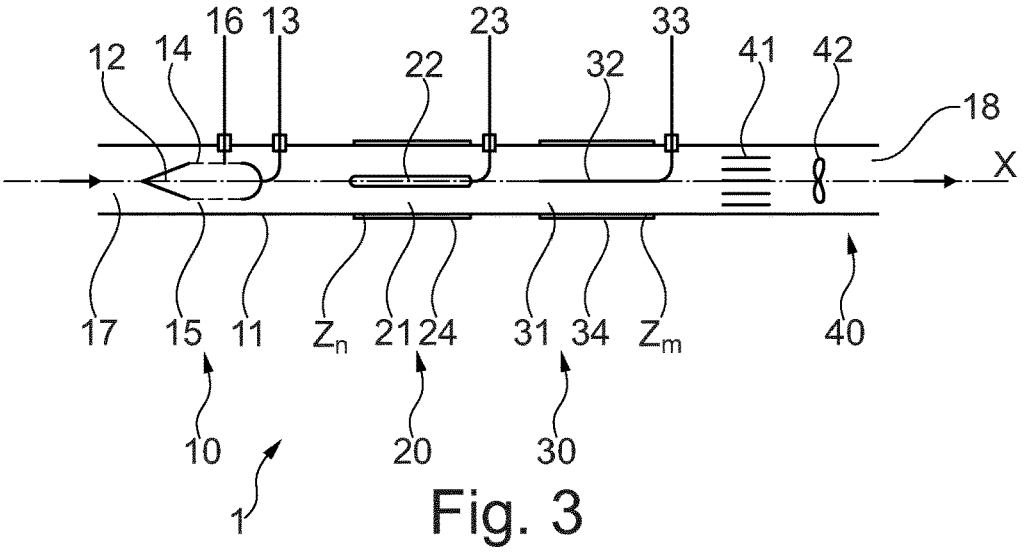
FIG. 3 is a schematic longitudinal cross-sectional view of a first example of a particle collection device according to the invention.

FIG. 3 shows a first example of an electrostatic device 1 according to the invention for selectively collecting particles likely to be contained in an aerosol.

Such a device according to the invention allows both the finest particles, such as nanoparticles, and the biggest particles, such as micron-sized particles, to be collected whilst separating them from each other according to their size range.

The collection device 1 firstly comprises a conduit 11, which is a hollow cylinder of revolution about the longitudinal axis X and which is electrically connected at low voltage, for example, at a voltage of 50 V, and even at zero potential.

The collection device 1 comprises four distinct stages 10, 20, 30, 40, inside the conduit 11, in the upstream to downstream direction, between its inlet orifice 17 and its outlet orifice 18.

Figure 1A:
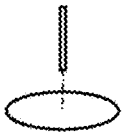
FIGS. 1A to 1E are schematic views of different configurations of electrodes for obtaining a corona electrical discharge effect.
Figure 1B:
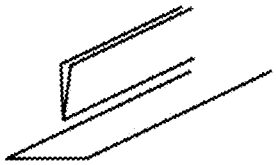
Figure 1C:
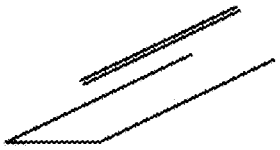
Figure 1D:
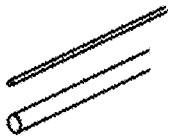
Figure 1E:
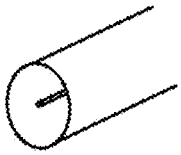
Figure 2:
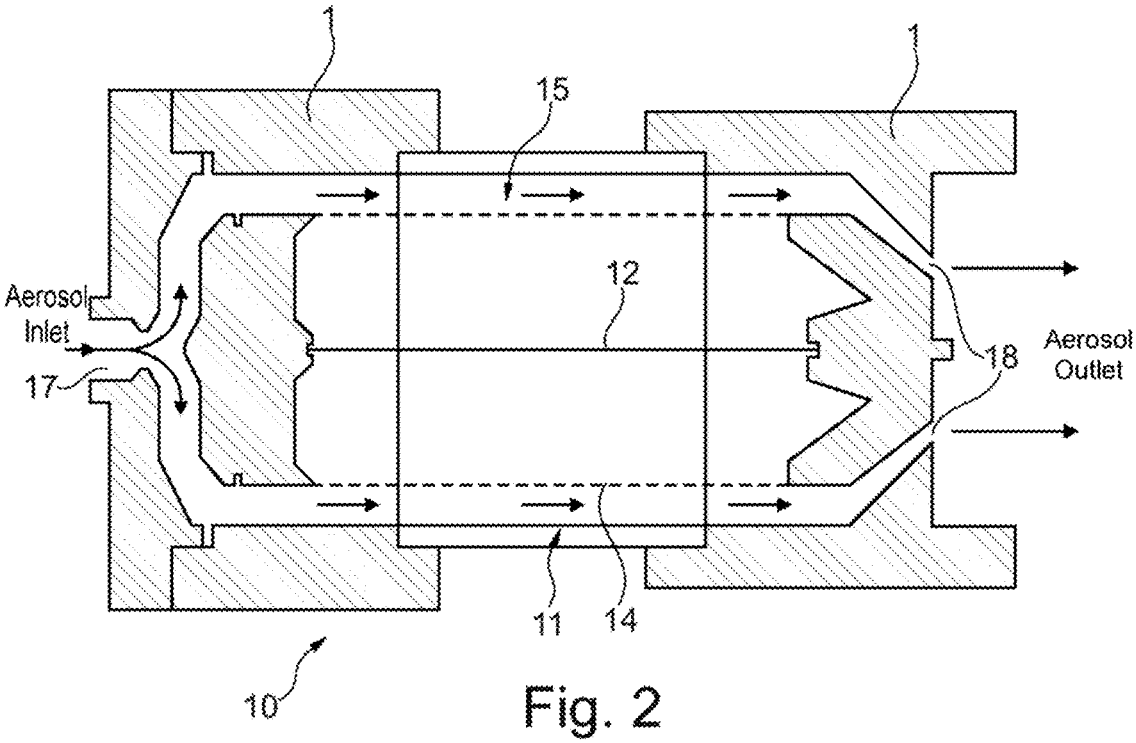
FIG. 2 is a longitudinal cross-sectional view of a charging device or a unipolar ion diffusion charger.

The first stage is formed by a unipolar ion diffusion charger 10 and is similar to that which was previously described with reference to FIG. 2.

The charger 10 thus comprises a central electrode that extends along the axis X in the form of a wire 12 connected to a power supply 13 delivering a high voltage adapted to thus create a corona discharge in the vicinity of the wire 12.

It further comprises a peripheral electrode in the form of a gate 14 connected to a low-voltage power supply 16.

The stage 20, downstream of the charger 10, comprises a central electrode that extends along the axis X in the form of a rod 22 connected to a power supply 23 delivering a medium voltage, adapted to create an electric collection field without a corona effect in the space 21 separating the central electrode 22 and the wall of the conduit 11. A hollow cylinder 24, conforming to the wall of the conduit and forming a first collection zone Zn, is arranged around the rod 22 opposite thereto.

The stage 30, downstream of the stage 20, comprises a central electrode that extends along the axis X in the form of a wire 32 connected to a high-voltage power supply 33, adapted to create a corona effect in the vicinity of the wire 32 and thus an intense electric field in the space 31 separating the central wire 32 from the conduit 11. A hollow cylinder 34, conforming to the wall of the conduit and forming a second collection zone Zn, is arranged around the wire 32 opposite thereto.

The stage 40 comprises a structure 41, for example, a "honeycomb" structure, adapted to prevent the appearance of a vortex in the conduit 11, and, downstream, a suction device 42. Depending on the configurations, the collection device according to the invention may dispense with the structure 41.

The operation of the collection device previously described with reference to FIG. 3 is as follows.

Air containing the particles to be collected is sucked through the inlet orifice 17 by the action of the suction device 42.

The finest particles of the aerosol are electrically charged by unipolar ion diffusion in the space 15 separating the gate 14 from the conduit 11.

These finest particles, with high electrical mobility, and the other bigger particles with lower electrical mobility, enter the stage 20.

The electric field without a corona effect created in the space 21 between the rod 22 and the cylinder 24 ensures that the finest particles are collected on the cylinder while defining the first collection zone Zn.

The other bigger particles are not collected and are still present in the aerosol that enters the third stage 30.

These biggest particles are then electrically charged under the corona effect in the vicinity of the wire 32 and the intense field pervading the space 31 and are collected on the internal wall of the cylinder 34 while defining the second collection zone Zm.

The air that is purified both of the finest particles deposited in the first collection zone Zn and of the biggest particles Zm is then discharged through the outlet orifice 18 of the device.

Each of the zones Zn and Zm then may be analyzed using conventional physical or physico-chemical characterization techniques, such as optical or electron microscopy, surface scanner, α, β, γ spectrometry if the particles are radioactive, X-ray fluorescence (XRF) spectroscopy, micro X-ray fluorescence (μ-XRF), laser-induced breakdown spectroscopy (LIBS), etc. in order to determine the particle size, on the one hand, of the finest particles and, on the other hand, of the biggest particles, their concentration, their chemical composition and/or their morphology.

Advantageously, provision may be made for the collection cylinders 24 and 34 to be formed by the same part, which thus forms a single collection substrate, which may be easily removed from the conduit once the intended collection is complete.

FIG. 4 shows another advantageous example of a collection device 1 according to the invention that allows the particles to be collected not on one or more cylinders arranged along the aerosol flow axis, as shown in FIG. 3, but on the same disk-shaped substrate 6 placed on its support 5 and arranged orthogonal to the axis of symmetry of the collection device.

In addition to better compactness, the collection device shown in FIG. 4 has the advantage, compared to that shown in FIG. 3, of being able to collect all the particles on the same flat substrate surface in concentric rings as a function of their relative dimensions, the biggest particles preferably being collected at the center of the surface, whereas the finest particles are preferably collected at the periphery.

Furthermore, the collection device shown in FIG. 4 advantageously allows the ionic wind to be exploited that is created by the point-plane configuration for collecting the biggest particles, and thus induces an air circulation through the device in its downstream section. This air circulation may even allow the presence of a suction pump to be dispensed with, which considerably reduces the weight of the collection device according to the invention and also allows its disturbances to be reduced (vibrations, noise, etc.).

The collection disk 6 is preferably conductive, typically made of metal, even semi-conductive. Its diameter is preferably between 10 and 25 mm, more preferably approximately 20 mm.

The collection device 1 has a cylindrical rotational geometry about the longitudinal axis X and comprises an elongated hollow body 11 surrounded by a casing 110, which may or may not be conductive and is surmounted by an electrically insulating body 3, in which the electrodes are fixed and through which the electrical power supplies are realized. By way of a variant, the body 11 and the casing 110 may be one piece.

The conductive casing 110, as well as the body 11 and the support 5, may be connected at zero potential by the power supply terminal 2. It is also possible to use a casing 110 and the body 11 made of insulating material thus taken to floating potential and for the support 5 to be held at zero potential by an electric wire connecting it to the power supply terminal 2.

The hollow body 11 defines on the inside thereof, with an insulating element 4 and a collection substrate 6 and its support 5, the conduit for circulating the aerosol from the inlet orifice 17 to the outlet orifice 18.

The collection device 1 according to FIG. 4 comprises the same elements as that of FIG. 3 as previously explained, but basically differs therefrom as follows:

- the part for creating the corona effect for collecting the biggest particles is in a point-plane configuration, the point 32 being at a distance from the plane of the collection substrate 6 arranged orthogonal to the axis X;
- the corona effect central wire 12 for unipolar ion diffusion, the rod 22 for generating an electric field without a corona effect for collecting the finest particles and the corona effect point 32 for collecting the biggest particles forming one and the same central electrode having portions 12, 22, 32 that are continuous but with different geometry.

More specifically, the unipolar ion diffusion charger is formed by a portion of the central electrode in the form of a wire 12 and a gate 14 arranged around the central wire 12. The diameter of the central wire 12 is preferably less than 50 μm.

In the extension of the gate 14, an insulating element 4 reasonably allows both the centering and the fixing of the electrode portion in the form of a rod 22 that is thus electrically connected to the wire 12.

The rod 22 ends with a tapered point 32 facing the collection disk 6. Preferably, the angle of the point is less than 35° and the greatest width of its apex (summit) is less than 50 μm.

The collection device 11 advantageously may comprise, in its downstream section, i.e. in the expanded part of the aerosol circulation conduit, downstream of the gate 14, plasma actuators 8 that allow the flow of air purified of particles to be controlled in this downstream section, before it is discharged through the outlet orifice 18, as explained hereafter.

A single high-voltage power supply 13, 23, 33 allows the corona effect to be produced both in the vicinity of the wire 12 and in the vicinity of the point 32. The high voltage is preferably selected between 2 and 6 kV, even more preferably at approximately 4 kV.

A low-voltage power supply 16, of approximately 100 V, allows the gate 14 to be biased to control the production of unipolar ions in the diffusion charging space 15.

It is to be noted that, in this device according to FIG. 4, there is no medium-voltage power supply, the electrode 22 allowing an electric field to be generated without a corona effect, as such, the medium-voltage field lines without a corona effect for collecting the finest particles, as described hereafter, in this case resulting from the high voltage applied to the point 32.

When the device is designed, attention is paid to providing suitable mechanical strength for the sub-assembly formed by the central electrode with different portions 11, 12, 32, the gate 14 and the insulating element 4, as well as to ensuring electrical continuity along the length of the high-voltage power supply 13, 23, 33 and the various portions 12, 22, 32 of the electrode.

Dimensioning is completed whilst ensuring that excessive narrowing is not introduced with a reduced cross section. This allows the pressure drop of the assembly to be minimized with respect to the air circulating in the annular space 15.

Therefore, the operation of the collection device according to FIG. 4 is similar to that of FIG. 3.

The aerosol circulates from the inlet orifice 17 to the outlet orifice 18 due to the fact that suction is effected from the outlet orifice.

The finest particles are electrically charged by unipolar ion diffusion in the annular space 15, whereas the biggest particles are electrically charged under the action of the intense electric field in the space 31 between the point 32 generating the corona effect and the collection substrate 6.

FIG. 4 shows a possible embodiment of the collection device 1 that avoids the use of an auxiliary suction pump. Under the effect of the ionic wind created in the space 31 between the point 32 and the collection substrate 6, a vacuum occurs in the annular space 15 for diffusion charging, which creates a circulation in the device at the flow rate q.

Suction may be optimized by the relatively wide opening of the outlet orifice 18, through the selection of the high voltage applied to the point 32 and by the distance between the point 32 and the plane 6.

As shown in FIG. 4, it is possible to maintain and even increase the circulation of air purified of particles that occurs in the downstream section of the conduit using plasma actuators 8 arranged in the vicinity of the outlet 18. These plasma actuators 8 advantageously are of the type used in microelectronics for cooling microcomponents. Therefore, by increasing the flow of purified air, there is an overall increase in the collection flow rate q that passes through the device. Finally, at a defined geometry and a defined high voltage there is a corresponding settable collection flow rate q.

Figure 5:
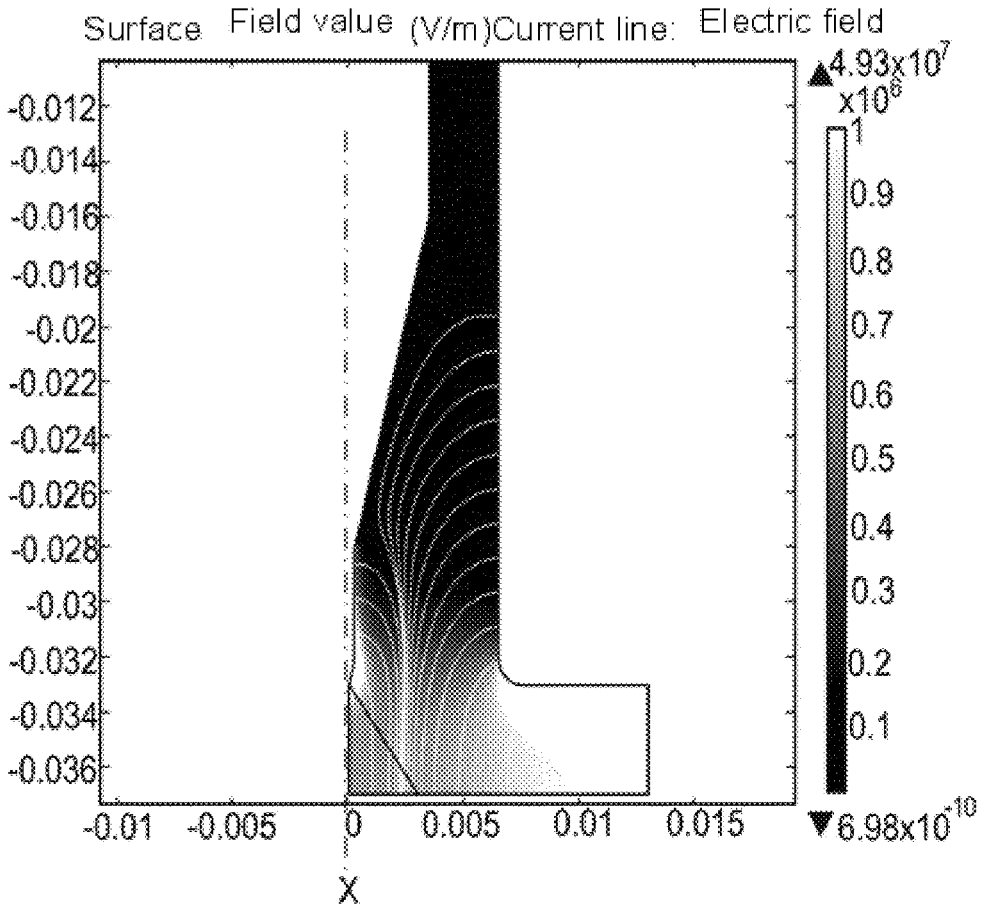
FIG. 5 is a view showing the simulation undertaken using finite element computation software for determining the electric field lines in the downstream part of the device.

FIG. 5 shows the electric field lines that occur in the downstream part of the aerosol circulation conduit. With the field lines being perpendicular to the equipotential lines, the field lines may be contained by the equipotentials inside the collection zones.

FIG. 5 clearly shows that the point 32 allows a locally very intense electric field to be obtained, which allows the air to be ionized and the microparticles to be charged. However, by moving further away from the vertical this very quickly decreases to a value of approximately $0.5*10^6$ V/m at the location where the particles pass. The device according to the invention, as shown in FIG. 4, is designed with a portion 111 of the wall of the hollow body 11 forcing the air flow moving toward the outlet 18 to pass between two parallel walls, between which the electric field is significantly amplified up to a value of $10^6$ V/m. Furthermore, the 1 mm curvature radius at the bottom of the wall of the hollow body 11 is sufficient at the critical point to prevent any breakdown problem up to 4000 V.

Figure 6:
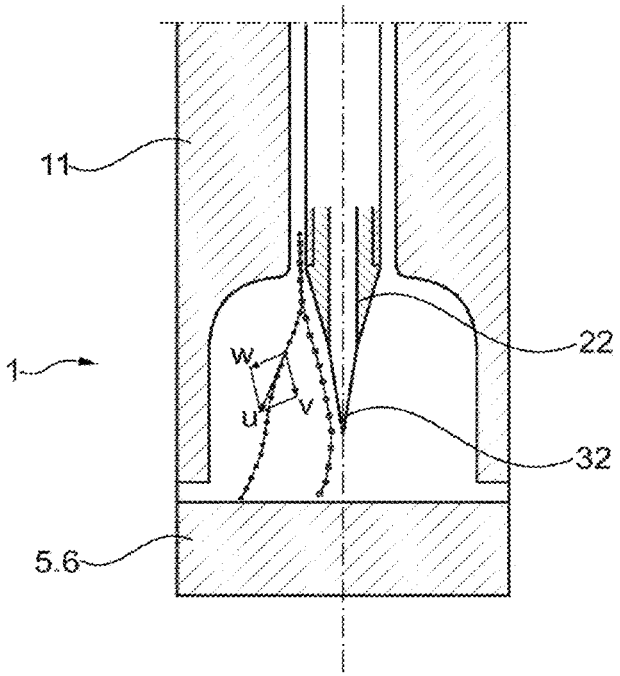
FIG. 6 is a view showing the forces experienced by the particles and examples of trajectories of two types of particles in the downstream part of a device according to the invention.

As shown in FIG. 6 it is the combination of the aeraulic and electrical effects applied to the particles that will define their trajectory and thus the zone of the substrate 6 in which they will be collected.

A fine particle, with high mobility, is immediately subject to the action of the surrounding radial electric field, which is expressed by an outward radial speed w, whilst being carried by the aeraulic field, which is expressed by an inward radial speed v. The resulting vector, speed u, thus defines the trajectory and the point of impact of this particle on the collection disk 6.

Therefore, for a plurality of fine particles with the same mobility, injected into the annular space 15 in a laminar manner, the point of impact defines an impact circumference or ring Zn on the substrate 6, taking into account the symmetry of revolution of the device.

With respect to the biggest particles, with lower mobility, these are not charged by diffusion, they arrive in the vicinity of the point 32, are electrically charged by bombarding ions locally produced by the corona effect between the point 32 and the substrate 6 and are thus deposited thereon in the vicinity of the axis X on impact circumferences Zm with radii that are smaller the bigger their size.

The particles are thus collected on the disk in concentric circles as a function of their particle size, with the finest on the outside and the biggest in the center.

The inventors have attempted to quantitatively evaluate the efficiency of a collection device 1 as previously described with reference to FIGS. 4 to 6.

A first evaluation was conducted on the basis of air charged with 2 μm diameter polystyrene latex (PSL) beads, marketed by ABCR under the name ABCR 210832.

This first evaluation allows an illustration to be provided of the mechanism for field effect charging of micron-sized particles in the space 31 between the point 32 and the metal collection substrate 6 and their deposition thereon.

The inventors proceeded as follows.

An aqueous suspension of PSL beads is atomized using a TSI branded aerosol generator, model 3076, then dried by a TSI branded desiccant column, model 3062.

The aerosol that is thus generated is then introduced into a chamber, in which the collection device 1 is located, as shown in FIGS. 4 to 6, at a flow rate of 3.6 L/min.

The chamber is provided with an outlet orifice that allows an overpressure to be avoided since the flow rate that is prescribed by a pump outside the collection device, within the range of 0.4 to 1.4 L/min, is always less than the aerosol flow rate entering the chamber.

In this example, a prescribed flow rate Q is applied to the collection device 1 in order to force a flow to pass through the collection device from the inlet orifice 17 to the outlet orifice 18 using a variable flow rate pump that is controlled by a flow meter.

The high voltage 13, 23, 33 applied to the central electrode 12, 22, 32 is examined for the positive (+) and negative (−) polarities of from 1500 V to 4000 V and this is undertaken for various distances z between the end of the point 32 and the collection substrate 6.

Figure 7:
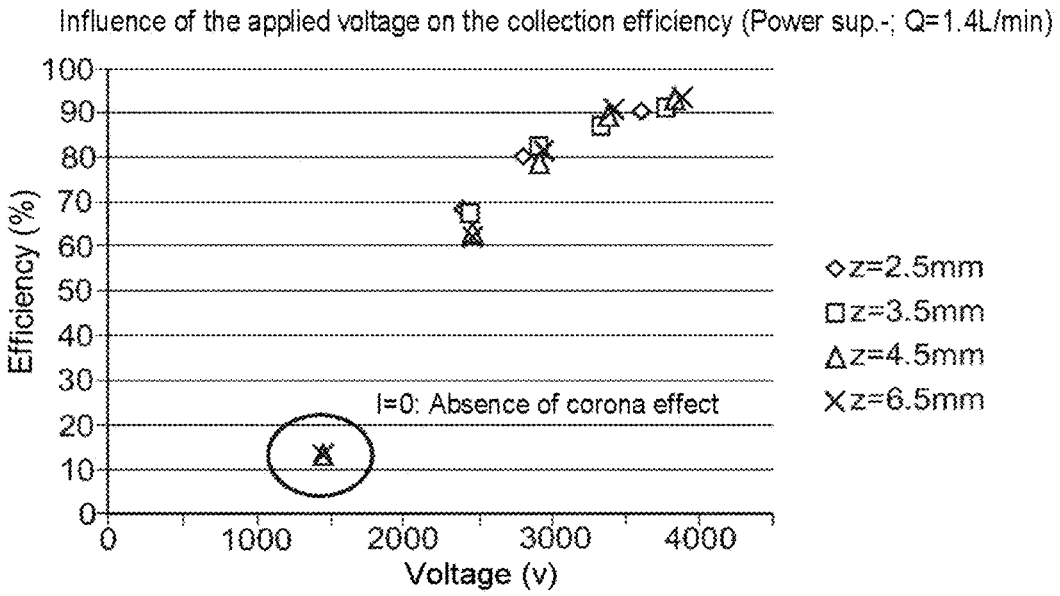
FIG. 7 is a graph characterizing the influence on the collection efficiency of the voltage applied to the point electrode for obtaining the corona effect in a device according to FIG. 4 for various distances between the point electrode and the collection substrate according to the invention (negative polarity)

FIG. 7 shows that for a constant flow rate of 1.4 L/min, the collection efficiency, which is expressed by the ratio expressed as a percentage between the number of particles exiting the device and the number of particles entering, increases when the applied voltage (as an absolute value) increases. For an applied voltage between 3500 and 4000 V (as an absolute value), the collection efficiency plateaus at around 90% regardless of the distance between the point 32 and the plane of the substrate 6, which is varied from 2.5 mm to 6.5 mm.

Figure 8:
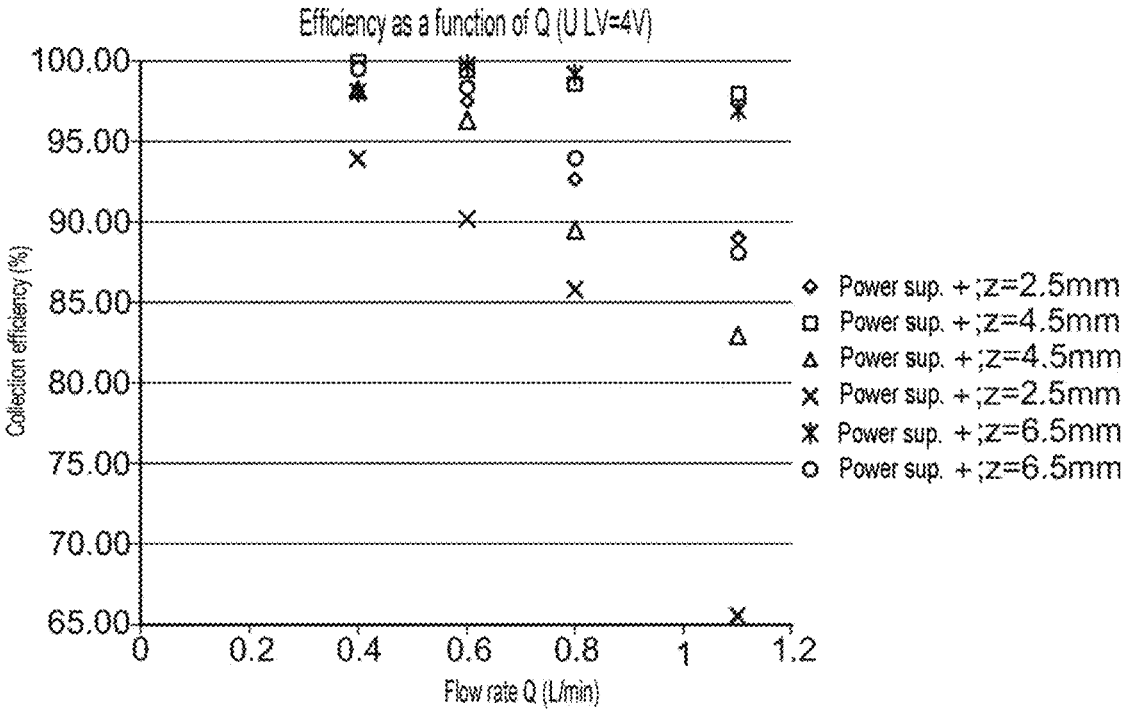
FIG. 8 is a graph characterizing the influence on the collection efficiency of the aerosol flow rate in a device according to FIG. 4 for various distances between the point electrode and the collection substrate according to the invention and for different polarities.

FIG. 8 for its part shows that, overall, the collection efficiency is highest when the flow rate is low, which is particularly the case for a flow rate of 0.4 L/min. Furthermore, it may be seen that for a fixed flow rate, the collection efficiency is higher when the negative polarity is used and when the point-plane distance is significant.

These evaluation examples show that the collection device according to the invention, as described in FIGS. 4 to 6, may be used to collect micron-sized particles using a field effect charging mechanism created by the point 32 taken to high voltage with a collection efficiency of more than 95%.

Figure 9:
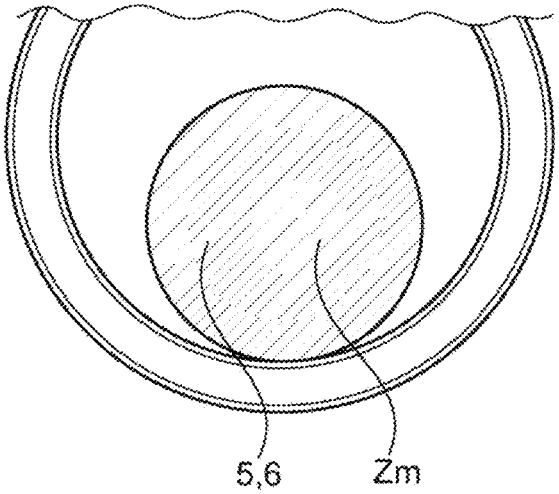
FIG. 9 is a photographic reproduction of a collection substrate implemented in a device according to the invention as shown in FIG. 4, with FIG. 9 showing a zone Zm for collecting micron-sized particles (2 μm diameter polystyrene latex beads)

FIG. 9 shows a photographic reproduction of a 20 mm diameter copper collection substrate 6, on which the micron-sized particles have been collected: it clearly shows that they are deposited in a concentric ring Zm relative to the axis X of the device or even of the point 32. This white ring Zm corresponds to the deposition of the 2 μm diameter PSL particles.

The inventors have also simulated the operation of the collection device according to the invention, as shown in FIGS. 4 to 6, using finite element computation software marketed under the name "COMSOL Multiphysics".

The collection device 1, with the same geometry as that shown in FIGS. 4 to 6, may be studied using the COMSOL software by viewing the flows, the electric fields, the trajectories of particles and the generated ionic wind.

Figure 10:
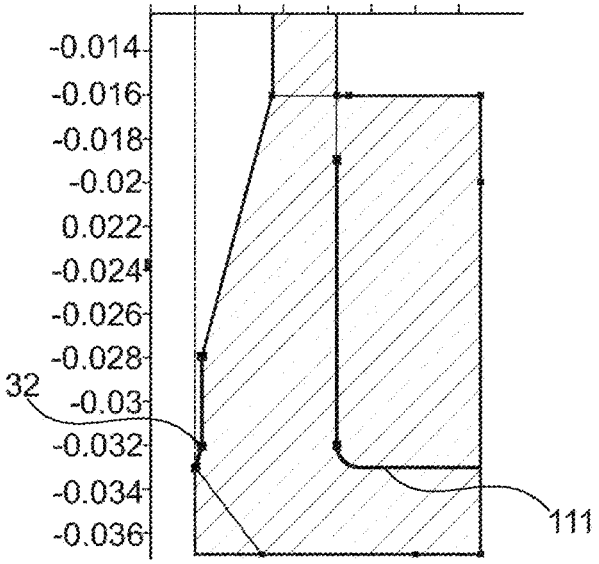
FIG. 10 is a view showing the description of models used to undertake a simulation using finite element computation software for determining the flows and the electric fields that occur in a device according to the invention as shown in FIG. 4.

FIG. 10 is a view showing the description of models used to undertake a simulation using finite element computation software for determining the flows and the electric fields that are produced in a device according to the invention, as shown in FIG. 4.

In the geometry shown in FIG. 10, and which corresponds to that of the device shown in FIG. 4, the expanded wall portion 111 is taken to the same potential as the point 32. Within the context of the invention, it is obvious that this portion 111 may be at a different potential to that of the point 32.

Figure 11:
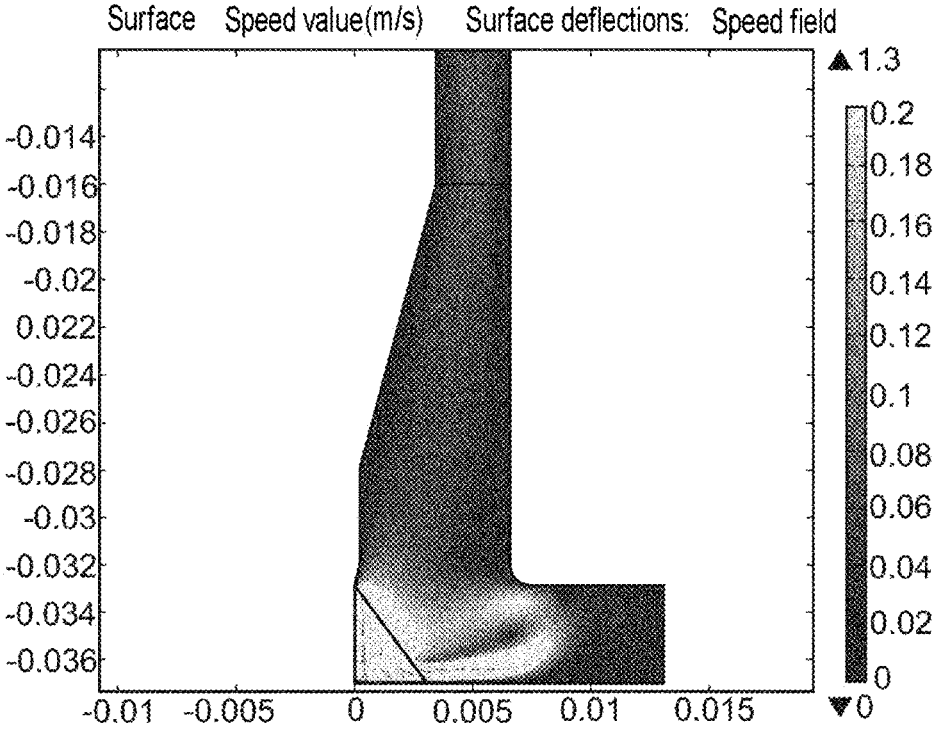
FIG. 11 is a view originating from the simulation by the finite elements computation software for determining the speed profiles of particles, as well as the ionic wind produced in a device according to the invention as shown in FIG. 4.

FIG. 11 shows the simulation of the flow for a distance z of 4 mm between the point 32 and the plane 31 and an applied voltage U of +4000 V at the point 32 and at the portion 111.

The representation in FIG. 11 clearly highlights the generation of a plasma produced by a corona effect under the point 32 where the electric fields are highest, with this plasma inducing an ionic wind toward the collection disk 6. The jet that is thus produced spreads over the surface of the collection disk.

It is also possible to note from this FIG. 11 that this ionic wind to a certain extent sucks the aerosol upstream of the point 32 toward the field effect charging zone 31 and thus contributes to the excellent collection efficiencies encountered for the biggest particles, the trajectories of which will not have been deflected by the field lines, since they are not charged in the upstream ion diffusion charging zone 15.

FIG. 11 shows that the portion 111 allows an aerosol circulation to be created in the device 1 according to the invention. By computing the average value of the inlet flow speed, using the "Comsol" finite element software, and by multiplying this value by the surface, a flow rate of approximately 0.5 L/min is obtained, which is a highly satisfactory value for obtaining collection efficiencies of more than 94%.

This has been experimentally verified on the device of FIG. 4 using a smoke generator. The smoke generator showed that the ionic wind did indeed lead to the creation of a suction flow rate without an external pump at the device inlet.

The inventors have also traced the trajectory of the particles in the device shown in FIG. 4 for 10 nm and 100 nm diameter nanoparticles and with a flow rate Q=0.5 L/min.

Figure 12:
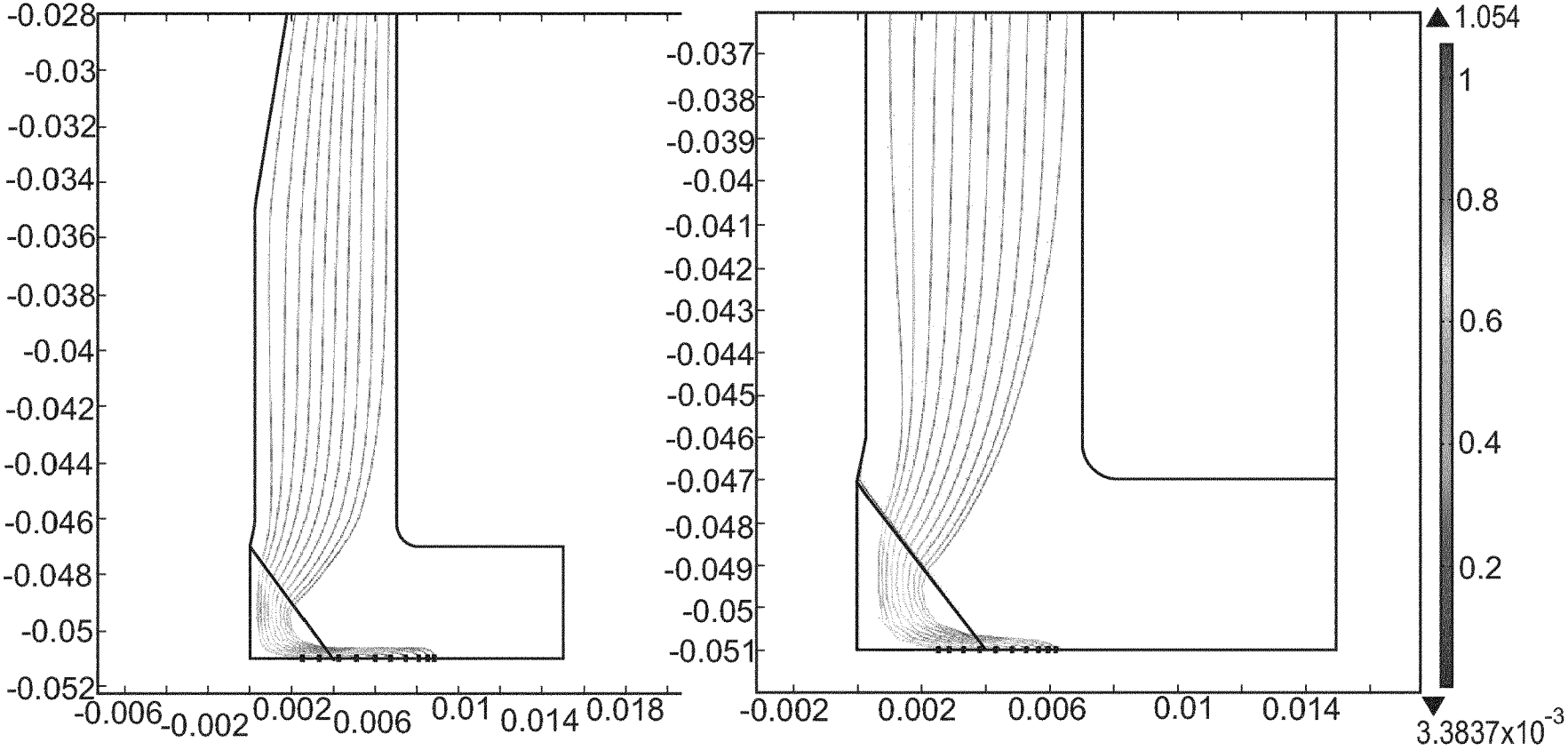
FIG. 12 is yet another view originating from the simulation by the finite elements computation software that shows the trajectories of particles with diameters equal to 100 nm (left-hand side of the figure.) and equal to 10 nm (right-hand side of the figure.) in a device according to the invention as shown in FIG. 4.

FIG. 12 thus shows the simulation, for an applied voltage U equal to +4000 V and for a distance z of 4 mm between the point 32 and the plane 31, of the trajectory of the particles respectively with a diameter of 100 nm on the left-hand side of the figure (n=4: number of elementary charges) and a diameter of 10 nm on the right-hand side of the figure (n=1)).

The "Comsol" finite element software showed that the nanoparticles are properly precipitated, i.e. deposited by electrostatic precipitation.

Therefore, the collection device 1 according to the invention, as shown in FIGS. 4 to 6, allows different sizes of particles to be collected simultaneously, by deposition onto the same support, for example, a metal disk, in concentric zones corresponding to well defined particle sizes. The biggest particles, typically the micron-sized particles, are collected in a central collection zone Zm, whereas the finest particles, typically the nanoparticles, are collected in a peripheral annular zone Zn.

The support then may be extracted from the rest of the collection device and then analyzed using conventional physical or physico-chemical characterization techniques (optical or electron microscopy, surface scanner, X-ray fluorescence, LIBS spectrometry, α, β, γ spectrometry if the particles are radioactive, etc.).

The collection device according to the invention is particularly well adapted for sampling particles in gaseous environments, particularly the air in premises or in the environment in order to determine the concentration, the particle size, the morphology and the composition of the aerosol particles that are likely to be inhaled. Due to its compact design and its reduced electrical consumption, this device may be portable and thus able to be rolled out on a large scale for a moderate cost.

According to an advantageous variant, the collection device according to the invention may operate as an ionization chamber. Thus, sequentially, according to a predetermined cycle, the device may operate as an aerosol collector during a time period $t_1$, then as a pulse counter during a time period $t_2$.

Indeed, if aerosols are previously deposited onto the substrate 6 during the collection phase (time period t1), then if the high voltage applied to the point 32 is subsequently less than the voltage for starting the corona effect during the counting phase (time period t2), this will create ionization of the air.

The ionization current collected by the point 32 then may be detected by a suitable electronic system, of the type commonly used in conventional ionization chambers.

When applied to radioactive aerosols, such an ionization chamber thus may form a radioactive contamination detector with an alarm function in the event that a predetermined threshold is exceeded. Furthermore, the collection substrate 6, which has fulfilled its role of collecting particles according to the invention, may be extracted in order to perform more thorough radioactive analyses, the subsequent advantage of which is a deposition of thin layers for the a spectrometry.

Other variants and improvements may be implemented without however departing from the scope of the invention.

The invention is not limited to the aforementioned examples; in particular, features of the illustrated examples may be combined in variants that have not been illustrated.

CITED REFERENCES

[1]: W. Hinds, "*Aerosol Technology*", 2nd *Edition*, 1999.

[2]: P. Intra and N. Tippayawong, *"Aerosol an Air Quality Research"*, 11: 187-209, 2011.

[3]: G. W. Hewitt, *"The Charging of small Particles for Electrostatic Precipitation"*, AIEE Trans., 76: 300-306, 1957.

[4]: G. Biskos, K. Reavell, N. Collings, *"Electrostatic Characterisation of Corona-Wire Aerosol Chargers"*, J. Electrostat. 63: 69-82, 2005.

[5]: D. Y. H. Pui, S. Fruin, P. H. McMurry, *"Unipolar Diffusion Charging of Ultrafine Aerosols"*, Aerosol Sciences Technology 8: 173-187, 1988.

[6]: P. Bérard, "*Etude du vent ionique produit par décharge couronne à pression atmosphésique pour le contrôle d'écoulement aérodyuamique*" [*Study of the ionic wind produced by corona discharge at atmospheric pressure for controlling aerodynamic flow*], Engineering Sciences, Ecole Centrale Paris, 2008, NNT: 2008ECAP1085, tel-01071389.

What is claimed is:

1. A method for collecting particles likely to be present in an aerosol comprising finest and biggest particles, the method comprising the following steps:

sucking the aerosol through a conduit comprising an internal wall, from its inlet orifice to its outlet orifice;

charging the finest particles, downstream of the inlet orifice, by unipolar ion diffusion in a space between an electrode under a form of a gate surrounding an electrode under a form of a wire generating a corona effect, and a first conductive portion of the internal wall of the conduit;

generating by an electric current an electric field without a corona effect in a space between an electrode and a second conductive portion of the internal wall of the conduit, in order to collect the finest particles of said aerosol charged by the unipolar ion diffusion by deposition onto a first collection zone (Zn);

generating by an electric current an electric field with a corona effect in a space between the wire or a point of an electrode and a third conductive portion of the internal wall of the conduit, in order to collect the biggest particles of said aerosol not charged by the unipolar ion diffusion by deposition onto a second collection zone (Zm) distinct from the first collection zone.

2. The method for collecting radioactive particles as claimed in claim 1, further comprising the following steps:

a) collecting radioactive particles on the first and/or the second collection zone during a time period t1;

b) counting pulses generated by the electric current in the spaces between an electrode and a second conductive portion of the internal wall of the conduit and between the wire or the point of an electrode and a third conductive portion of the internal wall of the conduit, during a time period t2.

3. The method for collecting radioactive particles as claimed in claim 2, comprising a step of emitting an alarm if a predetermined threshold value of pulses counted in step b) is exceeded.

4. A device for collecting particles likely to be present in an aerosol comprising finest and biggest particles, the device comprising:

a conduit comprising an internal wall, an inlet orifice and an outlet orifice, between which the aerosol may circulate;

suction means for circulating the aerosol from the inlet orifice to the outlet orifice;

a unipolar ion diffusion charger, downstream of the inlet orifice, comprising an electrode under a form of a wire surrounded by a first electrode under a form of a gate, the unipolar ion diffusion charger being adapted to charge the finest particles of said aerosol in a space separating the gate from a first conductive portion of the internal wall of the conduit by diffusing unipolar ions through the gate;

a second electrode, downstream of the unipolar diffusion charger, adapted to generate an electric field without a corona effect in a space separating the second electrode from a second conductive portion of the internal wall of the conduit and to thus collect the finest particles, previously charged by the unipolar ion diffusion charger, by deposition onto a first collection zone (Zn);

an electric field charger, downstream of the unipolar ion diffusion charger and of the first collection zone, comprising a third electrode under a form of a wire or a point adapted to generate an electric field with a corona effect in a space separating the wire or the point from a third conductive portion of the internal wall of the conduit and to thus charge, then collect, the biggest particles of said aerosol by deposition onto a second collection zone (Zm) distinct from the first collection zone.

5. The collection device as claimed in claim 4, wherein:

the conduit is a hollow cylinder of revolution about a longitudinal axis (X);

the suction means are formed by a pump;

the first, second and third conductive portions of the internal wall of the conduit are cylinder portions forming part of the conduit;

the electric field charger comprises an electrode under a form of a wire in a wire-cylinder configuration with the corresponding cylinder portion of the conduit;

the unipolar ion diffusion charger wire, the second electrode for generating the electric field without the corona effect and the wire of the electric field charger are distinct parts and are successively arranged one behind the other along the axis (X).

6. The collection device as claimed in claim 4, wherein:

the conduit comprises a hollow element of revolution about a longitudinal axis (X) and a flat substrate arranged at one end of the hollow element orthogonal to the axis (X), a distance separating the hollow element from the flat substrate and a possible support of said flat substrate defining dimensions of the outlet orifice, the flat substrate forming a collection substrate defining both the first (Zn) and the second (Zm) collection zone;

the suction means are formed by the outlet orifice;

the first conductive portion of the internal wall of the conduit is a portion of revolution forming the conduit;

the second and third conductive portions of the internal wall of the conduit are grouped on said collection substrate;

the electric field charger comprises an electrode under a form of a point in a point-plane configuration with said collection substrate, the point being adapted to generate the corona effect participating in the electric field charging of the particles but also for creating an electric field promoting a collection of species previously charged by the unipolar ion diffusion charger;

the wire of the unipolar ion diffusion charger, the electrode and the point of the electric field charger are portions of a part exhibiting electrical continuity that extends along the axis (X).

7. The collection device as claimed in claim 6, comprising plasma actuators arranged in the vicinity of the outlet of said conduit.

8. The collection device as claimed in claim 4, wherein the wire of the unipolar ion diffusion charger, the rod of the second electrode and the wire or the point of the unipolar ion diffusion charger are connected to a high-voltage power supply.

9. The collection device as claimed in claim 4, wherein the gate is connected to a low-voltage power supply.

10. The collection device as claimed in claim 4, the first, second and third conductive portions being connected at zero potential.

11. The collection device as claimed in claim 4, forming an air ionization chamber.

12. The collection device as claimed in claim 4, forming a radioactive particle detector.

* * * * *